US007588680B1

(12) United States Patent
Schucker

(10) Patent No.: US 7,588,680 B1
(45) **Date of Patent: *Sep. 15, 2009**

(54) DESULPHURIZATION OF PETROLEUM STREAMS USING METALLIC SODIUM

(75) Inventor: Robert C. Schucker, The Woodlands, TX (US)

(73) Assignee: Trans Ionics Corporation, The Woodlands, TX (US)

( * ) Notice: Subject to any disclaimer, the term of this patent is extended or adjusted under 35 U.S.C. 154(b) by 244 days.

This patent is subject to a terminal disclaimer.

(21) Appl. No.: 11/679,071

(22) Filed: Feb. 26, 2007

Related U.S. Application Data

(63) Continuation-in-part of application No. 10/826,621, filed on Apr. 16, 2004, now Pat. No. 7,192,516.

(60) Provisional application No. 60/501,343, filed on Sep. 9, 2003, provisional application No. 60/463,703, filed on Apr. 17, 2003.

(51) Int. Cl.
*C10G 29/04* (2006.01)
*C10G 23/00* (2006.01)

(52) U.S. Cl. ..... 208/208 M; 208/14; 208/143; 208/209; 208/230; 208/232; 208/235

(58) Field of Classification Search ..... 208/14, 208/143, 208 M, 209, 230, 232, 235
See application file for complete search history.

(56) References Cited

U.S. PATENT DOCUMENTS 2,002,747 A * 5/1935 Morrell ..... 208/214
7,192,516 B2 * 3/2007 Schucker ..... 208/208 M

* cited by examiner

*Primary Examiner*—Glenn Caldarola
*Assistant Examiner*—Prem C. Singh
(74) *Attorney, Agent, or Firm*—Winstead PC

(57) ABSTRACT

In some embodiments, the invention is a method of removing sulfur from a hydrocarbon feed using the steps of dissolving metallic sodium in a first solvent, combining the sodium/first solvent solution with a sulfur-free alkane or cycloalkane second solvent, vaporizing the first solvent from sodium/first solvent/second solvent combination to transfer the dissolved metallic sodium into the second solvent, and then combine the resultant liquid with a liquid hydrocarbon feed containing an organosulfur species. The resulting stream is combined with a hydrogen donor. The combination is heated and pressurized to form a liquid hydrocarbon product containing sodium sulfide. The liquid hydrocarbon product containing sodium sulfide is then cooled, and the sodium sulfide is extracted.

21 Claims, 1 Drawing Sheet

DESULPHURIZATION OF PETROLEUM STREAMS USING METALLIC SODIUM

CROSS REFERENCE TO RELATED APPLICATIONS

This application is a continuation-in-part of patent application Ser. No. 10/826,621, filed Apr. 16, 2004. This application claims the priority benefit under 35 USC § 119(e) to Provisional Patent Application No. 60/501,343, filed Sep. 9, 2003, and provisional Patent Application No. 60/463,703, filed Apr. 17, 2003.

STATEMENT REGARDING FEDERALLY SPONSORED RESEARCH OR DEVELOPMENT

None.

FIELD OF INVENTION

The invention relates to methods and products for the desulfurization of a wide range of liquid feeds containing organosulfur compounds by using metallic sodium dissolved in a solvent to create highly dispersed sodium for higher efficiency in sulfur removal.

BACKGROUND OF INVENTION

The literature describes several ways of removing sulfur from petroleum streams, which fall into two primary categories: (a) catalytic hydrotreating processes in which the feed is passed over a hydrotreating catalyst at elevated temperatures and hydrogen pressures and (b) non-hydrotreating processes. The present invention is an improved non-hydrotreating process.

Non-hydrotreating processes can be further divided into those that remove the entire sulfur-bearing molecule from the feed by adsorption onto a selective adsorbent, as exemplified by Khare (U.S. Pat. No. 6,274,533; U.S. Pat. No. 6,338,794 and U.S. Pat. No. 6,482,314), and those that remove only the sulfur by chemical reaction. The latter can further be divided into those that are oxidative in nature, as exemplified by Rappas (U.S. Pat. No. 6,402,940), Ohsol, et al (U.S. Pat. No. 5,985,137; U.S. Pat. No. 5,948,242), Yen (U.S. Pat. No. 6,402,939) and Gunnerman (U.S. Pat. No. 6,500,219), and those that are reducing in nature. The most important of the reducing processes is reaction of a feed containing organosulfur species with elemental sodium as exemplified by Brons, et al (U.S. Pat. No. 6,210,564), Baird (U.S. Pat. No. 4,003,824; U.S. Pat. No. 4,123,350) and Bearden (U.S. Pat. No. 3,787,315; U.S. Pat. No. 3,788,978; U.S. Pat. No. 3,791,966; U.S. Pat. No. 3,976,559 and U.S. Pat. No. 4,076,613).

In order to contact elemental sodium with feed, the sodium is typically melted (m.p.=97.8° C.) and added to the feed as a dispersion of small droplets. Even with intense mixing, it is not possible to produce extremely small droplet sizes. As a result, sodium on the surface of the droplets may react with sulfur in the feed to form a skin of sodium sulfide ($Na_2S$). This skin remains on the droplet exterior surface, and as $Na_2S$ has a melting point of 1,180° C., it remains as a solid under the conditions of desulfurization. The skin thereby inhibits further reaction between the sodium in the interior of the droplet and sulfur in the feed. For these reasons, it has been necessary in the prior art to use substantially higher ratios of sodium to feed sulfur than are stoichiometrically required in order to remove sulfur to the desired level.

BRIEF DESCRIPTION OF INVENTION

The present invention is directed to the process of removing sulfur from a wide range of liquid feeds which overcomes limitations in the prior art. The invention is a process of removing sulfur from a liquid feed containing organosulfur compounds and the products of said process The process may involve dissolving metallic sodium in a first solvent to form a solution of sodium atoms. The process may involve combining the solution of sodium atoms with a second solvent to form a combined stream, wherein the combination occurs at a temperature of addition and at a pressure above the vapor pressure of the solvent used to dissolve the metallic sodium at the temperature of addition. In some embodiments, the second solvent is a substantially sulfur-free solvent. For example, the substantially sulfur-free solvent may be selected from a group consisting essentially of alkane or cycloalkane species, or combinations thereof. An example of an alkane species include mineral oil and aromatic-free substantially sulfur-free kerosene. An example of a cycloalkane specie includes decahydronaphthalene. The process may involve reduced combined stream by lowering the pressure of the combined stream to achieve vaporization of the first solvent from the combined stream. The process may involve dispersing the reduced combined stream into a liquid hydrocarbon feed stream comprising organosulfur species to form a feed stream. The process may involve passing the feed stream into a pressurized reactor vessel in addition to a hydrogen-donor stream. For example, the hydrogen-donor stream may be selected from a group consisting essentially of hydrogen or a hydrogen donor solvent, or combinations thereof. The process may involve reacting the feed stream and the hydrogen-donor stream for a sufficient time and at sufficient temperature to form a modified composition comprising sodium sulfide and less organosulfur species that had been present in the feed stream. The process may further involve cooling the modified composition. The process may further involve extracting the sodium sulfide from the modified composition using an extraction fluid. According to some embodiments, the invention may include the products of the aforementioned process. According to some embodiments, the first solvent used is anhydrous ammonia. According to some embodiments, the temperature of addition is at or below the melting point of metallic sodium. For example, the temperature of addition may be about 25° C. According to some embodiments, the sufficient time may be in the range of about 5 and 60 minutes. According to some embodiments, the sufficient temperature may be in the range of about 25° C. and 350° C. For example, the sufficient temperature may be in the range of about 200° C. and 350° C. According to some embodiments, the extraction fluid composition may include a solvent for sodium sulfide. For example, the solvent for sodium sulfide may be substantially anhydrous ammonia. According to some embodiments, the molar ratio of sodium to sulfur may be in the rage of about 2.5:1 to 2:1.

It is readily apparent to those skilled in the art that many different solvents, including but not limited to ammonia and some ethers, may be used to dissolve metallic sodium. It is also apparent to those skilled in the art that that many different reactor and flow configurations may be used to carry out the desulfurization process.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following descriptions taken in conjunction with the accompanying drawings, in which.

DETAILED DESCRIPTION OF THE INVENTION

Figure 1:
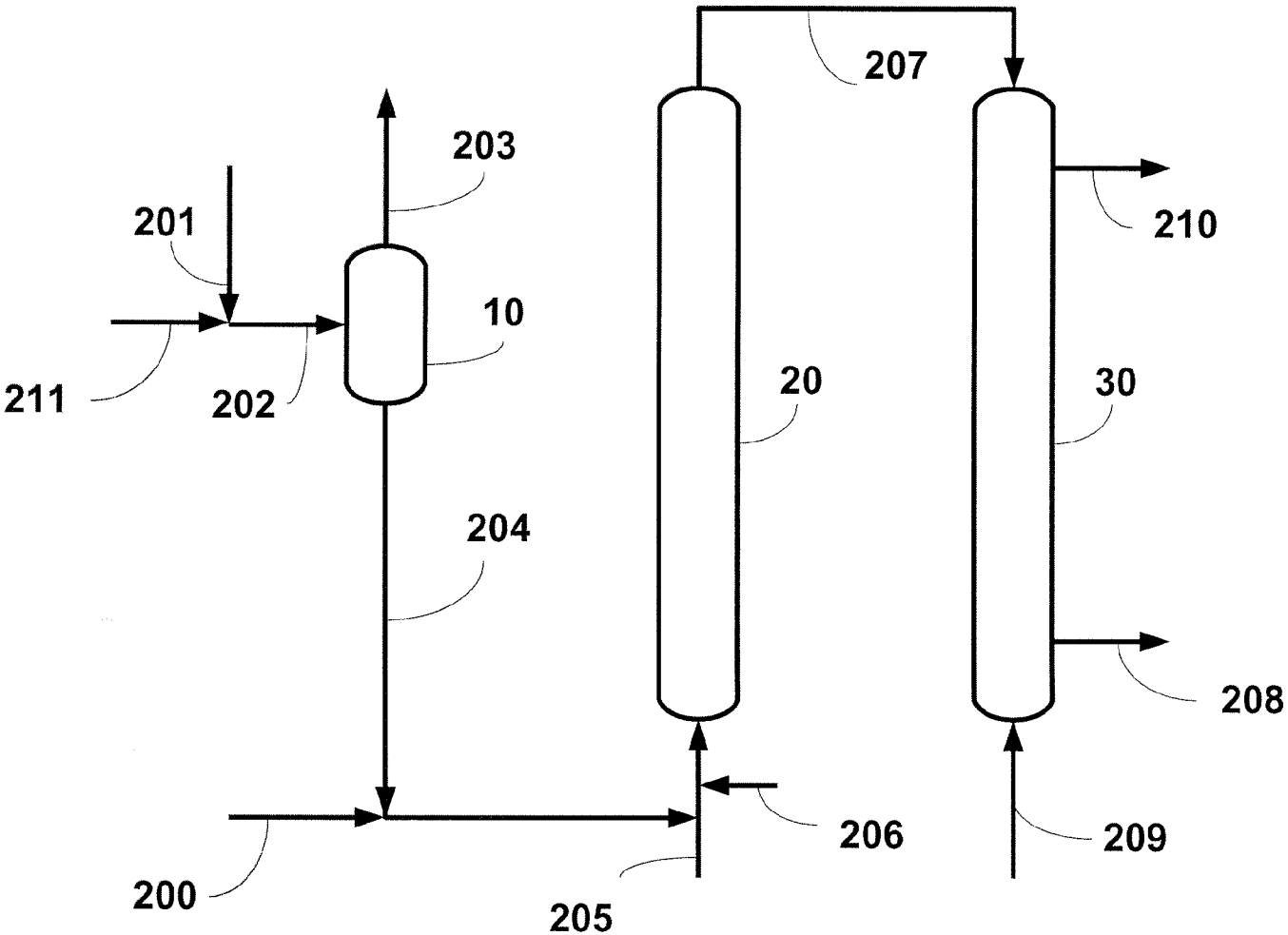
FIG. 1 illustrates a schematic of an embodiment of the process described in the application.

The principles of the present invention and their advantages are best understood by referring to FIG. 1 of the drawings, like numerals being used for like and corresponding parts of the various drawings.

In the following descriptions and examples, specific details are set forth such as specific quantities, sizes, etc., to provide a thorough understanding of the present invention. However, it will be obvious to those skilled in the art that the present invention may be practiced without such specific details. In many cases, details concerning such considerations and the like have been omitted inasmuch as such details are not necessary to obtain a complete understanding of the present invention and are within the skills of persons of ordinary skill in the relevant art.

In FIG. 1, metallic sodium is dissolved in a first solvent to create a solution of sodium atoms. In some embodiments, liquid anhydrous ammonia is used as the first solvent. The solution of sodium atoms is introduced into the process via stream 201. Stream 201 is maintained at a temperature and pressure so that the first solvent remains in the liquid phase. In some embodiments, a temperature in the range of about 25° C. to the melting point of metallic sodium (97.81° C.) is used. In some embodiments, a temperature in the range of about 0° C. to the melting point of metallic sodium is used. For the remainder of the description, it is assumed that liquid anhydrous ammonia is the first solvent.

Sodium is well known to be very soluble in liquid ammonia (U. Schindewolf, Angew. Chem. Internat. Edit., Vol. 7 (1968)/No. 3) with solubilities as high as 6 M (approximately 20 wt %) possible. In some embodiments, the concentration of sodium in ammonia is 0.1 to 20 wt %. In some other embodiments, the concentration of sodium in ammonia is 0.5 to 20 wt %. In some other embodiments, the concentration of sodium in ammonia is 1.0 to 20 wt %. The formation of the solution of sodium atoms can be assisted by using small pieces of sodium metal and using agitation, such as that provided with ultrasonic mixing, to assist in forming the solution.

In some embodiments, the temperature of the solution of sodium atoms should be about 25° C. to minimize the total pressure. Temperatures higher than 25° C. can be employed but those embodiments require the use of higher pressures in order to maintain the ammonia in the liquid phase. It is desired that the temperatures remain below the critical temperature of ammonia (132.6° C.) since sodium is not as soluble in supercritical ammonia as in liquid ammonia.

In some embodiments, the stoichiometric molar ratio of sodium to feed sulfur in a liquid hydrocarbon feed is around 2:1, corresponding to the composition $Na_2S$. In some embodiments, a slightly higher ratio may be needed (e.g., 2.1:1) to account for inherent inefficiencies in the process, such as some sodium failing to contact an organosulfur molecule.

Stream 201, the solution of sodium atoms, is combined and blended with a stream 211 to create a combined stream 202. Stream 211 is essentially composed of a second solvent that is relatively compatible with the hydrocarbon feed stream and can maintain the dissolved sodium atoms in solution. In some embodiments, the second solvent is a substantially sulfur-free solvent. For example, the substantially sulfur-free solvent may be an alkane solvent, such as mineral oil or an aromatic-free, substantially sulfur-free kerosene, or a cycloalkane solvent, such as decahydronaphthalene. Stream 211 is maintained at a temperature and pressure so that, when combined with stream 201, the first solvent remains in the liquid phase. In some embodiments, a temperature in the range of about 25° C. to the melting point of metallic sodium (97.81° C.) is used. In some embodiments, a temperature in the range of about 0° C. to the melting point of metallic sodium is used.

By introducing the metallic sodium into the process via a first solvent, the problems associated with the previously described formation of a sodium sulfide "crust" on molten sodium droplets is mitigated. Both first and second solvents should be water-free since water contained in the solvent would react readily with metallic sodium thus forming sodium hydroxide, which is not effective for removal of sulfur from organosulfur species. Additionally, by use of a second solvent that has affinity with the hydrocarbon stream to be processed, the delivery of sodium atoms to the target organosulfur molecules is enhanced.

The combined stream 202, comprised of the first solvent, the second solvent, and solubilized sodium atoms, is delivered into separator vessel 10, which, in some embodiments, is maintained at a pressure below the vapor pressure of the first solvent at a operating temperature. In some embodiments, the operating temperature is in the range of about 25° C. to 95° C. The operating temperature provides a means for removal of the ammonia, which is again assumed to be the first solvent, by vaporization. In some embodiments, the vapor pressure of the combined stream 202 entering the vessel is higher than that of the liquid composition exiting the vessel 10 via the bottom. The pressure drop in vessel 10 results in the flashing of the first solvent and produces a liquid solution at the bottom of vessel 10 comprised mainly of finely divided, extremely small (i.e., microparticulate or nanoparticulate) sodium particles well distributed throughout the second solvent.

Because of their size, the sodium particles now dispersed in the second solution have a much smaller volume than larger droplets of liquid sodium employed in the processes of the prior art, however, due to the lack of a sodium sulfide skin, the effective surface area (that available for as a reactant surface) of these particles is greater than that available from a comparable amount of liquid sodium droplets used in the prior art processes.

Ammonia flashed from the combined stream 202 in vessel 10 exits the vessel through line 203. The tails of the flashing process, mainly comprised of fine sodium particles and the second solvent, exits through line 204 as the reduced combined stream. In some embodiments, the temperature of stream 204 is maintained below the melting point of sodium, thereby eliminating coalescence of sodium droplets prematurely. Flashing at temperatures above the melting point of sodium may increase the potential for sodium to coalesce in the resulting feed 204.

The reduced combined feed 204 is then blended with a liquid hydrocarbon feed stream comprising organosulfur species 200, creating a feed stream 205.

In some embodiments, a hydrogen donor is introduced into the feed stream 205 through line 206 and the mixed hydrogen/feed stream is fed into the desulfurization reactor 20. Assuming the hydrogen donor is hydrogen gas, the hydrogen pressure in these embodiments is significantly lower than in catalytic hydrotreating systems (about 800-1500 psig). The chemistry of desulfurization of sulfur compounds with metallic sodium results in significantly lower hydrogen consumption than in hydrotreating methods. In some embodiments, the hydrogen pressure is in a range from about 25 psig to 500 psig. In some other embodiments, the hydrogen pressure is in a range from about 50 psig to 400 psig. In some other embodiments, the hydrogen pressure is in a range from about 100 psig to 300 psig.

Stream 206 will need to be heated to reaction temperature prior to entering reactor 20. In some embodiments, mixed hydrogen/feed stream is held at a reaction temperature for a sufficient length of time to promote the reaction between metallic sodium and organosulfur species. The desired temperature and pressure will depend on the particular organosulfur constituency of the feed, and the reaction time will depend upon the temperature and pressure chosen. In some embodiments, the reaction time is in the range of about 5 minutes to 60 minutes.

The reaction between sodium and organosulfur species occurs readily over a wide range of temperatures and can be shown to be highly thermodynamically favored in a temperature range of about 25° C. and 350° C. Dibenzothiophene has been desulfurized by sodium at 150° C. to produce 99% biphenyl as the product (Z. Yu et al., Energy and Fuels, 1999, 13, 23-28), while most of the prior art previously cited previously carried out the desulfurization reactions at higher temperatures. In some embodiments, the operating temperature for desulfurization is in a range of about from 25° C. and 350° C. In some other embodiments, the operating temperature for desulfurization is in a range of about from 100° C. and 350° C. In some other embodiments, the operating temperature for desulfurization is in a range of about from 200° C. and 350° C. In some embodiments, the preferred reaction temperature may exceed the melting point of sodium and hence raise the potential for sodium to coalescence within the feed prior to reaction with the organosulfur portion of the hydrocarbon. This effect can be minimized by choosing the reaction temperature/pressure to reduce the residence time of the feed in reactor 20, and, upon introduction or immediately prior to the introduction of the mixed hydrogen/feed stream into vessel 20, to rapidly heat the mixed hydrogen/feed stream temperature to the desired temperature. The desired temperature of the reactants can be less than that within the reactor 20 as the desulfurization reaction is exothermic, and hence, once the reaction begins, a temperature rise in the reactor 20 will occur. In certain embodiments, cooling of the reactant vessel may be desired.

It is also well known in the art that chemical reactions involving metallic sodium and organosulfur species occur more slowly at lower temperatures and more rapidly at higher temperatures; however, this may be a result of decreased available surface area of reactive sodium. In some embodiments, reactor residence time range from about 5 minutes to 240 minutes. In some other embodiments, reactor residence time range from about 5 minutes to 120 minutes. In some other embodiments, reactor residence time range from about 5 minutes to 60 minutes. Longer residence times result in increased capital cost because of the required larger reactor vessels.

Removal of sulfur from organosulfur species is also dependent on the hydrogen pressure. While desulfurization can be achieved under an inert atmosphere such as nitrogen, char formation (a coke precursor) is favored in that case (H. W. Sternberg et al, Ind. Eng. Chem, Proc. Des. Dev., 13(4), 1974, 433-436). In some embodiments, a hydrogen atmosphere is used. In some embodiments, a hydrogen donor solvent (a "solvent" in the sense of the hydrogen donor solvent being substantially miscible in the hydrocarbon feed) is used. For example, a hydrogen solvent includes but is not limited to tetra-hydronaphtalene or tetra-hydroquinoline. Additionally, in some embodiments, a combination of hydrogen gas and a hydrogen donor solvent could be used. Hydrogen gas or a hydrogen donor solvent, alone or in combination, will be considered a "hydrogen donor." Enough hydrogen to stabilize those molecules containing the sulfur is required. For instance, when the hydrogen donor is hydrogen gas alone, only one mole of hydrogen gas ($H_2$) per mole of sulfur is stoichiometrically required (again, slightly higher amounts of hydrogen may be needed to account for inherent inefficiencies in the process). Therefore, the present invention saves a significant amount of hydrogen over what is consumed in catalytic hydrotreating. In some embodiments, the hydrogen pressure is in a range of about 25 psig to 1000 psig. In some other embodiments, the hydrogen pressure is in a range of about 50 psig to 500 psig. In some other embodiments, the hydrogen pressure is in a range of about 250 psig to 300 psig.

The desulfurized feed now containing sodium sulfide ($N_2S$) exits reactor 20 through line 207. In some embodiments, the feed is cooled to a temperature below the critical temperature of the solvent (in the case of ammonia 132.7° C.). In some embodiments, the feed is fed to extraction vessel 30. Extraction fluid, which, in some embodiments, may be substantially anhydrous liquid ammonia (either from line 203 after compression or fresh liquid ammonia) or another suitable solvent, is added to the extractor 30 through line 209 and flows countercurrent to the feed to remove sodium sulfide. A residue solvent stream containing extracted sodium sulfide exits through line 210 and desulfurized product exits through line 208. In extractor 30, the solvent to feed ratio is adjusted to obtain the optimum performance, which is known to those skilled in the art. Further, the feed may be introduced at the top or the bottom of extractor 30 depending on the relative density of the feed versus the extraction solvent.

It will be recognized to those skilled in the art that the sodium sulfide reaction product may be removed by ordinary filtration, centrifugation or other means; however, these techniques are not expected to produce the quantitative removal of sodium sulfide achieved by extraction into liquid ammonia or a similar solvent.

In some embodiments, the hydrogen donor, in the form of hydrogen gas, is introduced in the process stream at the reactor vessel 20. In some embodiments, the hydrogen donor could be introduced into liquid hydrocarbon feed stream prior to the separation chamber reaction (flashing) such as by mixing with the feed stream prior to mixing with the sodium/solvent solution, or after mixing with the solution. In some embodiments, the hydrogen donor temperature should be close to that of the liquid stream. In some embodiments, the pressure of addition (for hydrogen gas) is in the range of about 5 and 200 psig. In some other embodiments, the pressure of addition is in the range of about 20 and 200 psig. In some embodiments, the pressure of addition is in the range of about 100 and 200 psig. In some embodiments, the molar ratio of donatable hydrogen to feed sulfur is in the range of about 1:1 to 2:1. Alternatively, the hydrogen donor, generally in the form of hydrogen gas, could be mixed with the solvent/sodium solution (to the solvent prior to the introduction of the sodium).

Although the present invention is described with several embodiments, various changes and modifications may be suggested to one skilled in the art. In particular, the present invention is described with reference to certain chemicals and materials and methods of processing those materials, but may apply to other types of processing or materials with little alteration and similar results. Furthermore, the present invention contemplates several process steps that may be performed in the sequence described or in an alternative sequence without departing from the scope and the spirit of the present invention. The present invention is intended to encompass such changes and modifications as they fall within the scope and the spirit of the appended claims.

What is claimed is:

1. A process for removing sulfur from a liquid hydrocarbon feed, comprising the steps of:

(a) dissolving metallic sodium in a first solvent to form a solution of sodium atoms;

(b) combining the solution of sodium atoms with second solvent to form a combined stream, wherein the combination occurs at a temperature of addition and at a pressure above the vapor pressure of the first solvent used to dissolve the metallic sodium at the temperature of addition;

(c) vaporizing the first solvent from the combined stream to create a reduced combined stream;

(d) dispersing the reduced combined stream into a liquid hydrocarbon feed stream comprising organosulfur species to form a hydrocarbon feed stream;

(e) passing the hydrocarbon feed stream into a pressurized reactor vessel in addition to a hydrogen-donor stream; and (f) reacting the hydrocarbon feed and hydrogen-donor streams to form a modified composition comprising sodium sulfide and less organosulfur species than previously present in the hydrocarbon feed stream, wherein the reaction occurs for a sufficient time and at a sufficient temperature.

2. The process of claim 1, further comprising cooling the modified composition.

3. The process of claim 1, further comprising extracting the sodium sulfide from the modified composition using an extraction fluid.

4. The process of claim 1, wherein the first solvent is anhydrous ammonia.

5. The process of claim 1, wherein the second solvent is a substantially sulfur-free solvent.

6. The process of claim 5, wherein the substantially sulfur-free solvent may be selected from a group consisting essentially alkane or cycloalkane species, or combinations thereof.

7. The process of claim 6, wherein the alkane specie is mineral oil.

8. The process of claim 6, wherein the alkane species is aromatic-free substantially sulfur-free kerosene.

9. The process of claim 6, wherein the cycloalkane species is decahydronaphthalene.

10. The process of claim 1, wherein the temperature of addition is at or below the melting point of metallic sodium.

11. The process of claim 10, wherein the temperature of addition is about 25° C.

12. The process of claim 1, wherein the sufficient time is in the rage of about 5 to 60 minutes.

13. The process of claim 1, wherein the vaporization of solvent occurs by lowering the pressure of the combined stream below the vapor pressure of the solvent at the temperature of addition.

14. The process of claim 1, wherein the sufficient temperature is in the range of about 25° C. to 350° C.

15. The process of claim 14, wherein the sufficient temperature is in the range of about 200° C. to 350° C.

16. The process of claim 1, wherein the extraction fluid may include a solvent for sodium sulfide.

17. The process of claim 16, wherein the solvent for sodium sulfide is substantially anhydrous ammonia.

18. The process of claim 1, wherein the molar ratio of sodium to sulfur is in the range of about 2.5:1 to 2:1.

19. The process of claim 1, wherein the hydrogen-donor stream may be selected from a group consisting essentially of hydrogen or a hydrogen donor solvent, or combinations thereof.

20. The process of claim 19, wherein the hydrogen donor solvent is tetra-hydronaphthalene.

21. The process of claim 19, wherein the hydrogen donor solvent is tetra-hydroquinoline.

* * * * *